United States Patent [19]

Tobias et al.

[11] Patent Number: 4,593,420

[45] Date of Patent: Jun. 10, 1986

[54] SELF-DRAINING HYDROMASSAGE FITTING

[75] Inventors: Samuel Tobias, Edison; Robert M. Messinger, Cranford, both of N.J.

[73] Assignee: Hayward Industries, Inc., Elizabeth, N.J.

[21] Appl. No.: 786,809

[22] Filed: Oct. 11, 1985

[51] Int. Cl.[4] ..... A04H 3/18; A61H 33/02

[52] U.S. Cl. ..... 4/496; 4/541; 4/542; 128/66; 239/428.5

[58] Field of Search ..... 4/541, 542, 543, 496, 4/492, 490; 128/66; 239/428, 428.5; 137/625.11, 893, 889

[56] References Cited

U.S. PATENT DOCUMENTS

| | | | |
|---|---|---|---|
| 3,890,655 | 6/1975 | Mathis | 4/542 |
| 3,946,449 | 3/1976 | Mathis | 4/542 |
| 4,416,030 | 11/1983 | Reynoso | 4/496 |
| 4,422,191 | 12/1983 | Jaworski | 4/496 |
| 4,502,168 | 3/1985 | Jaworski | 4/496 |
| 4,525,881 | 7/1985 | Higginbotham | 4/496 |
| 4,541,780 | 9/1985 | Moreland | 4/541 X |

*Primary Examiner*—Henry K. Artis

*Attorney, Agent, or Firm*—Lerner, David, Littenberg, Krumholz & Mentlik

[57] ABSTRACT

A hydromassage fitting employs a directional nozzle to inject an aerated jet of water into the interior of a water receptacle, such as a bathtub, spa, therapy tank or swimming pool. The directional nozzle is mounted in the fitting so as permit water to drain around the nozzle and into the water receptacle when the fitting is not in use, thereby inhibiting the collection of water in the fitting. Pockets and voids within the fitting are eliminated or sealed in order to further inhibit the collection of water in the fitting.

14 Claims, 2 Drawing Figures

FIG. 1
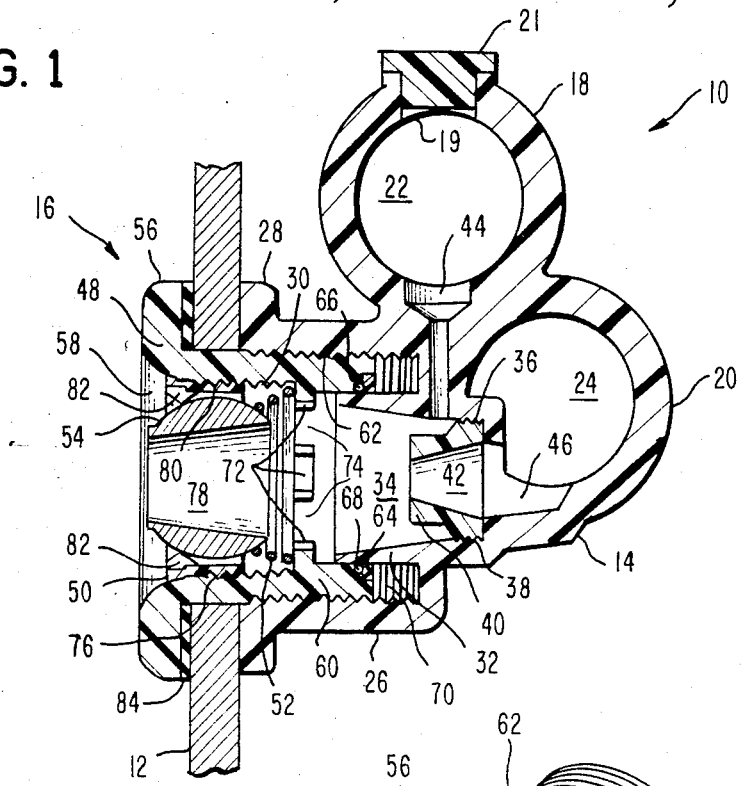
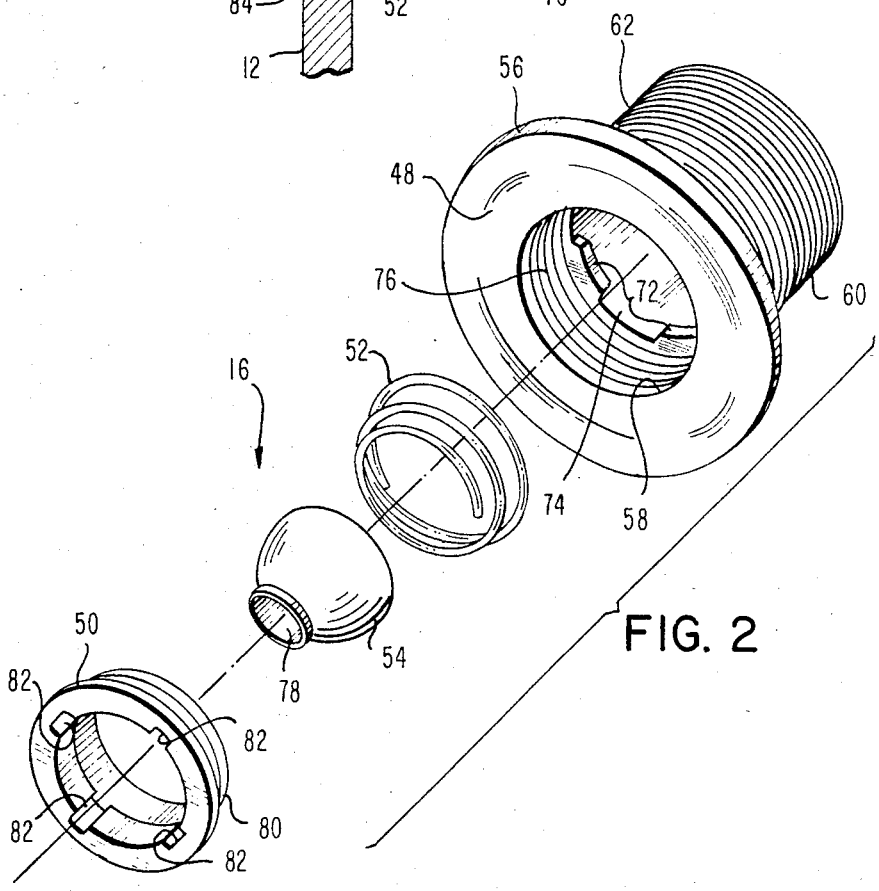
FIG. 2

SELF-DRAINING HYDROMASSAGE FITTING

FIELD OF THE INVENTION

The present invention relates to hydromassage fittings and, more particularly, to such fittings which are adapted to inject an aerated water jet into a water receptacle, such as a bathtub, spa, therapy tank or swimming pool.

BACKGROUND OF THE INVENTION

Recently, whirlpool baths have gained increasing popularity. In these baths, water is agitated to create an invigorating whirlpool motion which provides a type of hydromassage.

In the past, the desired whirlpool motion and hydromassage effect have been created by fittings designed to combine water and air into a jet and then inject the water and air jet into a water receptacle, such as a bathtub, spa, therapy tank or swimming pool, through a directional nozzle (see, for instance, U.S. Pat. Nos. 3,946,449, 4,335,854, 4,416,030 and 4,420,846). When used in an installation, such as a bathtub, in which the water is not treated with a sanitizing substance and in which the water is frequently drained from the receptacle, such fittings can create a potential unhealthy condition if they are not drained of substantially all water after use.

U.S. Pat. No. 4,358,862 discloses a connector assembly for a whirlpool system. The connector assembly connects an outlet or bulkhead fitting to air and water supply channels. In order to facilitate drainage of water from the air and water supply channels, the connector assembly employs an air inlet opening arranged at an elevation no higher than the elevation of the bottom of the air supply channel and a water inlet opening arranged at an elevation no higher than the elevation of the bottom of the water supply channel. Because the outlet or bulkhead fitting does not employ a directional nozzle adapted to control the direction of the aerated jet discharged from the outlet, drainage of the connector assembly is not hindered by such a nozzle.

SUMMARY OF THE PRESENT INVENTION

The present invention relates to a new and improved hydromassage fitting of the type which employs a directional nozzle adapted to adjust the direction of a jet of aerated water discharged from the fitting. In accordance with the improvement, the nozzle is mounted in the fitting so as to permit the drainage of substantially all water from the fitting. Because substantially all water is drained from the fitting, the present invention avoids a potentially unhealthy condition resulting from the stagnation of any residual water remaining in the fitting after its use.

In one embodiment adapted for use with a ball-type of directional nozzle, a locking ring and arcuate lugs cooperate with a conical coil spring to adjustably and removably mount the directional nozzle in the fitting downstream from a mixing chamber in which air and water are mixed together before being discharged in the form of a jet of aerated water from an outlet situated downstream from the directional nozzle. The lugs are spaced apart so as to permit the substantially complete drainage of water from the mixing chamber. The locking ring is provided with notches sized and shaped so as to permit the water draining from the mixing chamber to flow around the directional nozzle and out the outlet of the fitting, thereby inhibiting the collection of residual water in the fitting. By reducing or sealing pockets and voids in the interior of the fitting, the collection of residual water can be further inhibited.

BRIEF DESCRIPTION OF THE DRAWINGS

For a more complete understanding of the present invention, reference is made to the following detailed description of an exemplary embodiment considered in conjunction with accompanying drawings, in which:

FIG. 1 is a cross-sectional view of a hydromassage fitting constructed in accordance with the present invention; and FIG. 2 is an exploded view of an outlet assembly which forms a part of the hydromassage fitting illustrated in FIG. 1.

DESCRIPTION OF THE EXEMPLARY EMBODIMENT

Referring to FIGS. 1 and 2, there is shown a hydrotherapy or hydromassage fitting 10 mounted on the sidewall 12 of a water receptacle, such as a bathtub, spa, therapy tub or swimming pool. The fitting 10 includes a main body 14 and an outlet assembly 16.

The main body 14, which is made from a suitable polymeric material, includes a socket-type connector pipe 18 for air and a socket-type connector pipe 20 for water. The connector pipe 18 has an air conduit 22 which communicates with an air supply distribution system (not shown). A hole 19 in the connector pipe 18 is provided to facilitate molding of the main body 14. The hole 19 is permanently blocked by a plug 21. The connector pipe 20 has a water conduit 24 which communicates with a water supply distribution system (not shown). The main body 14 also includes an outer sleeve 26, having an annular flange 28 and internal threads 30, and an inner sleeve 32, which delimits a mixing chamber 34 and includes internal threads 36 adapted to threadedly engage external threads 38 provided on an inner nozzle 40 so that the inner nozzle 40 can be removed and replaced with a replacement nozzle designed, for example, to satisfy different air and water supply conditions. The inner nozzle 40 includes a tapered passageway 42 for a purpose to be described hereinafter. A vertical channel 44 connects the air conduit 22 to the mixing chamber 34, while a horizontal channel 46 connects the water conduit 24 to the passageway 42 of the inner nozzle 40 and hence to the mixing chamber 34.

With particular reference to FIG. 2, the outlet assembly 16 includes a faceplate 48, a locking ring 50, a conical coil spring 52 and an outer nozzle 54 of the directional ball type. Except for the coil spring 52, which is made from metal, all of the other elements of the outlet assembly 16 are, for the most part, made from the same polymeric material as the main body 14 or from another suitable polymeric material.

The faceplate 48 is removably and adjustably attached to the main body 14. More particularly, the faceplate 48 includes an annular flange 56, which surrounds an outlet 58, and an elongated neck 60, which is provided with external threads 62 adapted to threadedly engage the internal threads 30 on the outer sleeve 26 of the main body 14. The neck 60 also includes a retaining ring 64, which is permanently attached to the neck 60 so as to form an annular groove 66 for a rubber O-ring 68 adapted to create a water-tight seal between the inner sleeve 32 of the main body 14 and the neck 60 of the faceplate 48 to thereby prevent water from collecting in a void 70 formed between the neck 60 of the faceplate 48 and the outer and inner sleeves 26, 32 of the main body 14 (see FIG. 1). The use of the retaining ring 64 is necessary in order to facilitate the molding of the faceplate 48. A plurality of arcuate lugs 72 extend inwardly from the neck 60 of the faceplate 48. The lugs 72 are spaced apart so as to form openings 74 provided for drainage purposes, as well as to provide gripping surfaces for a tool (not shown) adapted to remove and install the faceplate 48. The faceplate 48 also includes internal threads 76.

The locking ring 50, coil spring 52 and outer nozzle 54, which includes a tapered passageway 78, are housed within the faceplate 48. More particularly, the coil spring 52 is interposed between the lugs 72 of the faceplate 48 and the outer nozzle 54 such that the coil spring 52 constantly urges the outer nozzle 54 into intimate contact with the locking ring 50, thereby allowing the outer nozzle 54 to be maintained in any one of an infinite number of adjustable presettings. The locking ring 50 includes external threads 80 adapted to threadedly engage the internal threads 76 of the faceplate 48. The locking ring 50 is also provided with a plurality of notches 82 sized and shaped so as to receive a tool (not shown) adapted to install and remove the locking ring 50. The notches 82 also function to permit water to drain around the outer nozzle 54 and into the water receptacle through the outlet 58 of the fitting 10. The size of the notches 82 is critical because if they are too large an excessive amount of water will flow from the water receptacle into the mixing chamber 34 during the operation of the fitting 10. Such inflow of water will drastically reduce the efficiency of the fitting 10. Thus, the size of the notches 82 is critical in striking the proper balance between, on the one hand, avoiding the excessive inflow of water into the fitting 10 during operation and, on the other hand, affording sufficient drainage of the fitting 10 when it is not in operation. The locking ring 50 also functions to retain a decorative escutcheon plate (not shown) which is part of a trim kit. When such a kit is used, the locking ring 50, the outer nozzle 54 and the escutcheon plate (not shown) would be made from a material, such as brass, different from the polymeric material of the rest of the fitting 10.

The annular flange 56 of the faceplate 48 cooperates with the annular flange 28 on the outer sleeve 26 of the main body 14 to clamp the fitting 10 to the sidewall 12 of the water receptacle. Preferably, a gasket 84 is positioned between the annular flange 28 of the faceplate 48 and the sidewall 12 of the water receptacle to prevent leakage between the fitting 10 and the sidewall 12 of the water receptacle. Alternatively, the gasket 84 can be positioned between the sidewall 12 of the water receptacle and the annular flange 28 on the outer sleeve 26 of the main body 14. It is also possible to use two gaskets: one positioned between the flange 56 of the faceplate 48 and the sidewall 12 of the water receptacle and the other positioned between the flange 28 on the outer sleeve 26 of the main body 14 and the sidewall 12 of the water receptacle. A gasket substitute material, such as silicon cement, could be used in place of the gasket or gaskets.

In operation, water supplied under pressure to the water conduit 24 is forced through the inner nozzle 40 at high velocity due to the tapered configuration of the passageway 42 extending therethrough. After flowing into the mixing chamber 34, the water passes through the outer nozzle 54, whose tapered passageway 78 also increases the velocity of the water. The inner and outer nozzles 40, 54 cooperate to create a low pressure venturi effect in the mixing chamber 34. This low pressure venturi effect causes air to be drawn into the mixing chamber 34 from the air conduit 22. The mixture of air and water flows from the mixing chamber 34 through the outer nozzle 54 into the water receptacle in the form of a jet.

Persons skilled in the art will understand that when water is no longer supplied under pressure to the water conduit 24 (i.e., when the fitting 10 is not in operation), the entire fitting 10, including the air conduit 22, is filled with water. When the water is thereafter drained from the water receptacle, the water in the air conduit 22 drains through the vertical channel 44 into the mixing chamber 34, while the water in the water conduit 24 drains through the horizontal channel 46 and the passageway 42 in the inner nozzle 40 into the mixing chamber 34. Because the vertical and horizontal channels 44, 46 communicate with the lowermost portions of the air and water conduits 22, 24, respectively, substantially all of the water in the air and water conduits 22, 24 will flow into the mixing chamber 34. From the mixing chamber 34, the water drains through the openings 74 and the notches 82 and into the water receptacle through the outlet 58. The design of the openings 74 and the notches 82 is such that substantially all of the water in the mixing chamber 34 drains into the water receptacle.

It will be understood that the embodiment described herein is merely exemplary and that persons skilled in the art may make many variations and modifications without departing from the spirit and scope of the invention. For instance, although the exemplary embodiment employs a ball-type directional nozzle, the present invention is applicable to hydromassage fittings employing any other type of directional nozzle (see, for instance, U.S. Pat. No. 3,946,449). All such modifications and variations are intended to be included within the scope of the invention as defined in the appended claims.

1. A hydromassage fitting, comprising an outlet, a mixing chamber in which water and air are mixed, directing means positioned downstream from said mixing chamber for adjustably directing an aerated jet of water out of said outlet and mounting means for adjustably mounting said directing means within said fitting, said mounting means including draining means for draining water from said mixing chamber around said directing means and out said outlet, whereby substantially all of the water in said mixing chamber can be drained from said fitting when said fitting is not in use.

2. A hydromassage fitting according to claim 1, wherein said mounting means includes a faceplate, having a bore extending therethrough and a plurality of lugs extending radially into said bore, a locking ring positioned downstream from said lugs, and a conical coil spring interposed between said lugs and said directing means so as to urge said directing means away from said lugs and toward said locking ring.

3. A hydromassage fitting according to claim 2, wherein said draining means includes openings formed between adjacent pairs of said lugs and notches formed in said locking ring.

4. A hydromassage fitting according to claim 3, wherein said directing means is a ball-type directional nozzle.

5. A hydromassage fitting according to claim 4, further comprising an air conduit, a water conduit, another nozzle positioned between said water conduit and said mixing chamber, a first channel extending between said air conduit and said mixing chamber and a second channel extending between said water conduit and said another nozzle.

6. A hydromassage fitting according to claim 5, wherein said first channel communicates with a lowermost portion of said air conduit and said second channel communicates with a lowermost portion of said water conduit, whereby water in said air and water conduits is drained therefrom into said mixing chamber through said first and second channels.

7. A hydromassage fitting according to claim 6, wherein said mixing chamber is delimited by an inner sleeve of said fitting and said faceplate includes a neck movable back and forth along said inner sleeve, said neck and said inner sleeve cooperating to form an annular void within said fitting.

8. A hydromassage fitting according to claim 7, further comprising sealing means for creating a water-tight seal between said neck and said inner sleeve to thereby prevent the collection of water in said void.

9. A hydromassage fitting, comprising an outlet, a mixing chamber in which water and air mixed, a directional nozzle positioned downstream from said mixing chamber and adapted to direct an aerated jet of water out of said outlet and mounting means for adjustably mounting said directional nozzle within said fitting, said mounting means including a faceplate, having a bore extending therethrough and a plurality of lugs extending radially into said bore, a locking ring positioned downstream from said lugs, a conical coil spring interposed between said lugs and said directional nozzle so as to urge said directional nozzle away from said lugs and toward said locking ring, and draining means for draining water from said mixing chamber around said directional nozzle and out said outlet, said draining means including openings formed between adjacent pairs of said lugs and notches formed in said locking ring, whereby substantially all of the water in said mixing chamber can be drained from said fitting when said fitting is not in use.

10. A hydromassage fitting according to claim 9, wherein said directional nozzle is a ball-type directional nozzle.

11. A hydromassage fitting according to claim 10, further comprising an air conduit, a water conduit, another nozzle positioned between said water conduit and said mixing chamber, a first channel extending between said air conduit and said mixing chamber and a second channel extending between said water conduit and said another nozzle.

12. A hydromassage fitting according to claim 11, wherein said first channel communicates with a lowermost portion of said air conduit and said second channel communicates with a lowermost portion of said water conduit, whereby water in said air and water conduits is drained therefrom into said mixing chamber through said first and second channels.

13. A hydromassage fitting according to claim 12, wherein said mixing chamber is delimited by an inner sleeve of said fitting and said faceplate includes a neck movable back and forth along said inner sleeve, said neck and said inner sleeve cooperating to form an annular void within said fitting.

14. A hydromassage fitting according to claim 13, further comprising sealing means for creating a water-tight seal between said neck and said inner sleeve to thereby prevent the collection of water in said void.

* * * * *